US005486798A

United States Patent [19]

Veitschegger

[11] Patent Number: 5,486,798

[45] Date of Patent: Jan. 23, 1996

[54] MULTIPLANAR HYBRID COUPLER

[75] Inventor: William K. Veitschegger, Pickerington, Ohio

[73] Assignee: AT&T IPM Corp., Coral Gables, Fla.

[21] Appl. No.: 350,600

[22] Filed: Dec. 7, 1994

Related U.S. Application Data

[63] Continuation-in-part of Ser. No. 206,996, Mar. 7, 1994, abandoned.

[51] Int. Cl.[6] ..... H01P 5/18

[52] U.S. Cl. ..... 333/116; 333/246

[58] Field of Search ..... 333/116

[56] References Cited

U.S. PATENT DOCUMENTS

| | | | |
|---|---|---|---|
| 2,812,501 | 11/1957 | Sommers . | |
| 4,525,689 | 6/1985 | Wagner et al. | 333/116 X |
| 4,823,097 | 4/1989 | Konishi et al. | 333/116 |
| 4,882,555 | 11/1989 | Wong . | |
| 4,967,171 | 10/1990 | Ban et al. . | |
| 5,032,803 | 7/1991 | Koch . | |

OTHER PUBLICATIONS

"Characteristic Impedances of Broadside–Coupled Strip Transmission Lines", Seymour B. Cohn, IRE Transactions On Microwave Theory And Techniques, Nov. 1960, pp. 633–637.

"A Directional Coupler Of A Vertically Installed Planar Circuit Structure", Konishi, et al, IEEE Transactions On Microwave Theory And Techniques, vol. 36, No. 6, Jun. 1988, pp. 1057–1063.

"New Types Of 3–dB Directional Couplers Of Microstrip Transmission Lines", Dongtien, 1986 IEEE MTT–S Digest, #J–16, pp. 265, 266.

*Primary Examiner*—Paul Gensler

*Attorney, Agent, or Firm*—Ruloff F. Kip, Jr.

[57] ABSTRACT

A microwave directional coupler comprises a dielectric coupler board, elongate metallic strip conductors deposited on front and back surfaces of the board and having respective central portions electrically broadside coupled with each other through the board, and respective right and left hand lead portions terminating in ports at the bottom of the board. Metallic ground plane regions cooperate with those strip conductors to form corresponding microwave transmission lines comprising respective signal conductors provided by said strip conductors and respective grounded conductors provided by said regions. The ground plane regions are in the form of expanses of metallic layers deposited on the same surfaces of the board as are such strip conductors. Ground plane regions on opposite sides of the board are electrically connected by plated-through holes passing through the board. The coupler board is vertical and stands on a dielectric connector board having metallic strips thereon for connecting the strip conductors to external circuit elements.

22 Claims, 6 Drawing Sheets

MULTIPLANAR HYBRID COUPLER

RELATED APPLICATION

This application is a continuation-in-part of U.S. patent application, Ser. No. 08/206996 filed Mar. 7,1994 now abandoned, in the name of William K. Veitschegger for "Broadside Coupled Microwave Transmission Line Device" and assigned to the assignee hereof.

FIELD OF THE INVENTION

This invention relates generally to microwave directional coupler devices for electromagnetically coupling a plurality of two-conductor transmission lines, each comprising signal conductor means and ground conductor means, to provide for transfer of microwave energy between the two lines.

BACKGROUND OF THE INVENTION

A prior art device of the kind just described is disclosed in U.S. Pat. No. 5,032,803 issued Jul. 16, 1991 in the name of Michael J. Koch for "Directional Stripline Structure and Manufacture" and assigned to the assignee hereof (the "Koch"patent). That device comprises an inner dielectric board flanked by, and laminated with, two outer dielectric boards to form a multi-layer structure. The two signal conductor means respective to the mentioned pair of transmission lines take the form of two metallized striplines disposed on opposite sides of the inner board to be in broadside coupled relation with each other through the board. The two ground conductor means take the form of ground planes provided by two layers of copper respective to, and covering most of the surfaces of, the outer sides of the two outer boards. The striplines on the inner board are electrically connected through plated through-holes in the outer boards to contact pad lands formed on the outside of those boards.

While the technical performance of the coupler device of the Koch patent has been satisfactory, it has the disadvantage that, because of its multilayer structure, it is wasteful of materials and, moreover, is unduly difficult and expensive to manufacture.

U.S. Pat. No. 4,882,555 issued Nov. 21, 1989 in the name of M. N. Wong for "Plural Plane Waveguide Coupler" discloses a microwave coupler comprising a circuit board in the shape of a square to have four peripheral margins. The board comprises a dielectric substrate having top and bottom surfaces, and top and bottom metallic pads centrally located on, respectively, those top and bottom surfaces and disposed opposite each other through the board to be broadside coupled with each other. Two top metallic strips extend from junctions thereof with opposite ends of the top pad to two respective ports at the top and bottom margins of the board. Two bottom metallic strips extend from junctions thereof with opposite ends of the bottom strip to two respective ports at the left and right margins of the board. The pad and strips on each of the top and bottom surfaces of the substrate are bordered by slots by which they are spaced from expanses of metallic sheets on those surfaces and covering the entire areas thereof outside of said slots.

The Wong coupler has the disadvantage that its four ports are each at a different one of the four peripheral margins of Wong's circuit board so as to make it difficult and expensive to couple the Wong coupler to external microwave circuitry. Another disadvantage of the Wong coupler is that it is wasteful of space.

SUMMARY OF THE INVENTION

The foregoing and other disadvantages of the Koch and Wong couplers are overcome according to the invention hereof by improved coupler devices of the character set forth by the appended claims.

BRIEF DESCRIPTION OF DRAWINGS

For a better understanding of the invention, reference is made to the following description of an exemplary embodiment thereof, and to the accompanying drawings wherein.

Figure 1:
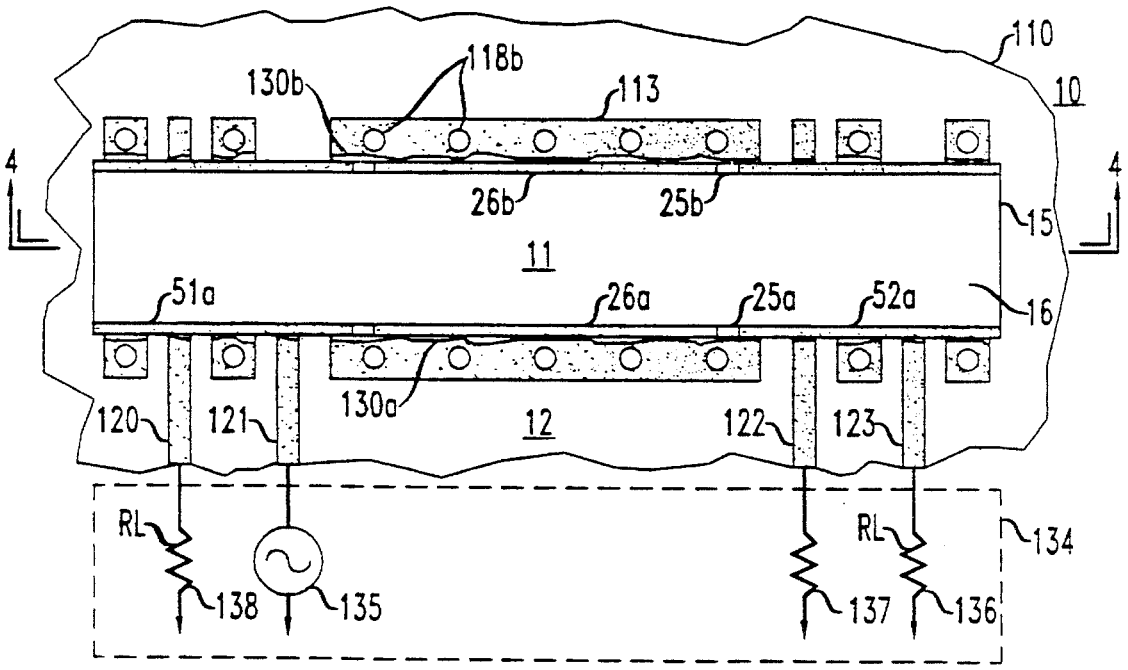
FIG. 1 is a plan view of an improved directional coupler according to the invention and comprising a coupler assemblage and a support assemblage which mounts, and provides connections for, the coupler assemblage, such support assemblage being shown broken-away in FIG. 1.

In the description which follows, elements which are counterparts of each other are designated by the same reference numerals having different alphabetical suffixes to designate different of those elements, and it is to be understood that a description of any of those elements shall, unless otherwise indicated by the context, be taken as being also applicable to any counterpart of that element. Moreover, while the invention may be described and/or claimed in terms of coordinates such as, say, "vertical" and "horizontal", the invention is not limited to any particular orientation thereof.

DETAILED DESCRIPTION OF THE EMBODIMENT

Figure 2:
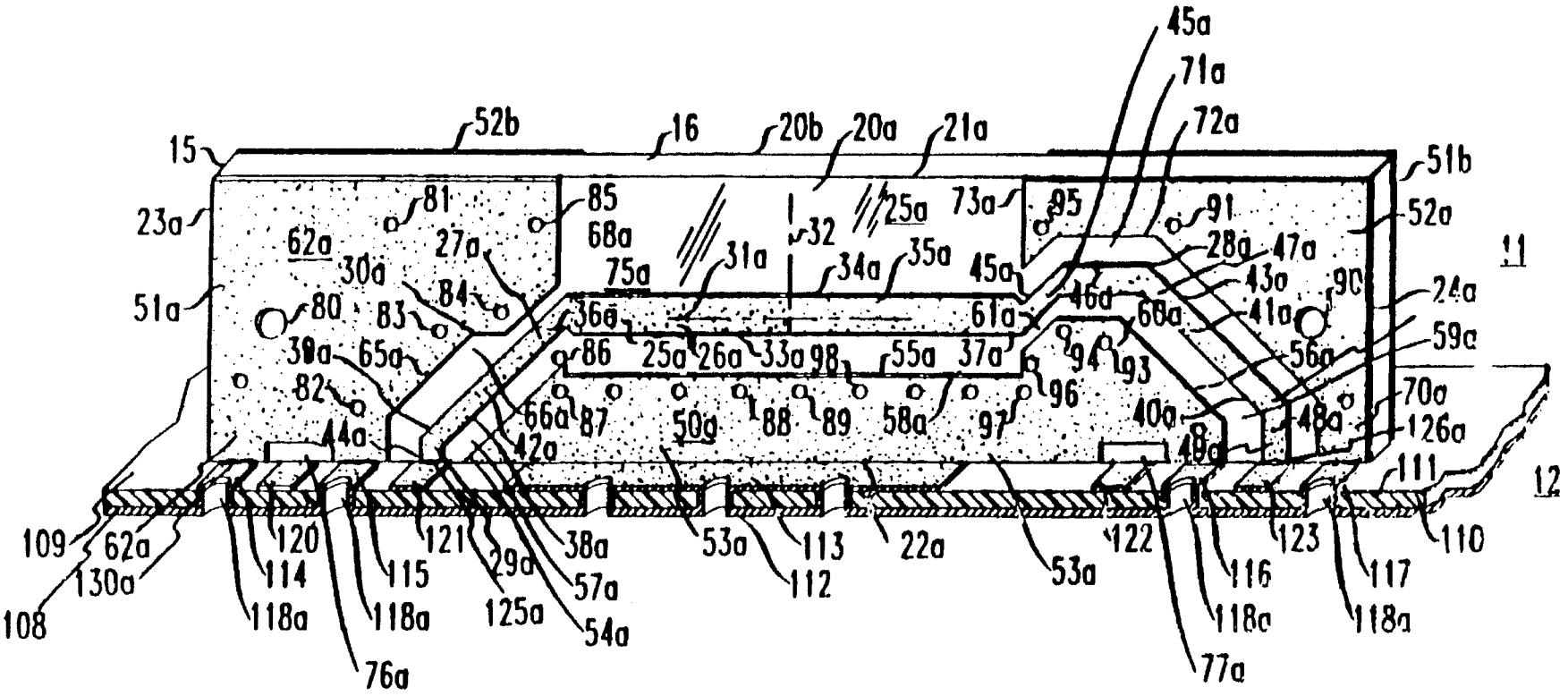
FIG. 2 is an isometric view of the front side of the FIG. 1 device.

Referring now to FIGS. 1 and 2, the reference numeral 10 designates a directional coupler device which is a representative embodiment of the invention hereof, and which comprises a coupler assemblage 11 and a connector assemblage 12 which mounts component 11 and provides connections therefor.

The coupler assemblage 11 comprises a substrate or body of dielectric material which in the device 10 takes the form of a planar rectangular coupler board 15 constituted of dielectric material 16. Board 15 extends in the transverse dimension which coincides with the direction of its thickness, and the board also extends in the longitudinal and lateral dimensions which are normal to the transverse dimension. In the figures hereof, the longitudinal and transverse dimensions are horizontal whereas the lateral dimension is vertical.

The board 15 has two parallel planar surfaces 20*a* and 20*b* which are on transversely opposite sides of the board to be spaced from each other by the thickness between those surfaces of the board's dielectric material. Those surfaces 20*a* and 20*b* are front and back surfaces, respectively in relation to the direction in the transverse dimension. That direction is hereinafter referred to as the front-to-back transverse direction and will be used hereinafter as a reference direction in describing various elements of the coupler device and, in particular, in describing left-right relations therebetween.

Considering now the front surface 20*a*, (FIG. 2) it is rectangular in shape and has a top peripheral margin 21*a*, a bottom peripheral margin 22*a* and side peripheral margins 23*a* and 24*a* which are left and right margins, respectively, in relation to the front-to-back transverse direction. Surface 20*a* has thereon an elongated flat metallic conductor 25*a* of electrical energy which is referred to herein as the front conductor and which in device 10 is provided by a metallic layer in the form of a thin layer of copper clad on surface 20*a*. The front conductor 25*a* comprises, as portions thereof, a front central strip 26*a* and two leads 27*a* and 28*a* which are, respectively, left and right front leads in relation to the front-to-back transverse direction.

Front central strip 26*a* has a horizontal centerline 31*a* and is axially symmetrical about a vertical axis 32 for board 15 and has a central location on front surface 20*a* in that the strip is located vertically intermediate the top and bottom margins 21*a*, 22*a* and horizontally intermediate its left and right side margins 23*a*, 24*a*. The strip 26*a* has lower and upper edges 33*a*, 34*a* and an expanse 35*a* between those edges, and the strip extends longitudinally between left and right hand ends 36*a*, 37*a* thereof at which the leads 27*a* and 28*a* have respective junction with the strip 26*a*.

The leads 27*a*, 28*a* have respective edges 38*a*, 39*a* and 40*a*, 43*a* and respective expanses 42*a*, 41*a* between those edges, and those leads are, (FIG. 2), narrower in breadth than central strip 26*a*. Outward of its junction with the center strip 26*a*, the left hand front lead 27*a* has a downwardly slanting section 30*a* which extends substantially linearly downward and longitudinally outward, to slant, at a downward angle to center line 31*a*, to a vertical section 44*a* of lead 27*a* extending down to a lower end or termination 29*a* of the section at the bottom margin 22*a* of the front surface 20*a*, such termination 29*a* constituting a port for lead 27*a*. The right hand front lead 28*a*, however, extends, outward of its junction with the center strip 26*a*, first upwardly and longitudinally outward over a section 45*a* of the lead to slant at an upward angle to centerline 31*a*. Then the lead has a level section 46*a* which is followed by a section 47*a* slanting downwards and outwards to a vertical lead section 48*a* extending down to a lower end or termination 49*a* of section 48*a* at the bottom margin 22*a* of the front surface 20*a*, such termination constituting a port for the lead 28*a*. Lead sections 30*a* and 44*a* form a dogleg lower portion for lead 27*a* while lead portions 47*a* and 48*a* form a dogleg lower portion for lead 28*a*.

The front surface 20*a* has thereon not only the strip conductor 25*a* but, also, three metallic expanses 50*a*, 51*a* and 52*a* constituting respective ground plane regions and provided by a metallic layer in the form of a thin copper layer clad on that surface. Region 50*a* is a central front region disposed in a central portion of board 15 below the front central strip 26*a* and longitudinally between the left and right front leads 27*a* and 28*a*. On its lower side, region 50*a* extends down to a termination 53*a* thereof at the bottom margin 22*a* of the surface 20*a*. A notch-shaped void 77*a* extends from that bottom margin into the metallic expanse of region 50*a*. On its upper side, the region 50*a* has edges 54*a*, 55*a*, 56*a* which are separated by gaps 57*a*, 58*a*, 59*a* from respectively the lower edge 38*a* of lead 27*a*, the lower edge 33*a* of central strip 26*a* and the lower edge 40*a* of the lead 28*a*. As shown by FIG. 2 the region 50*a* on its right hand side has an upwardly projecting head 60*a* of such shape that, near the junction, at the strip end 37*a*, of lead 28*a* with central strip 26*a*, the gap 59*a* between the edge 56*a* of region 50*a* and the lower edge 40*a* of lead 28*a* has a pinch 61*a* and is much narrower in width at that pinch than the width of gap 59*a* at a greater distance along lead 28*a* away from that junction.

The region 51*a* is a left front region disposed on surface 20*a* leftward of left front lead 27*a* and extending down to a termination 62*a* of the region at the bottom margin 22*a* of front surface 20*a*. A notch-shaped void 76*a* extends from that bottom margin into the metallic expanse of region 51*a*. Region 51*a* has a slanting angulated edge 65*a* separated by a gap 66*a* from the upper edge 39*a* of the lead 27*a*. That edge 65*a* is shaped to provide, near the junction, at strip end 36*a*, of lead 27*a* with strip 26*a*, a pinch 67*a* at which the width of gap 66*a* is much narrower than it is farther away along lead 27*a* from that junction. The slanting edge 65*a* intersects at about the level of the top edge 34*a* with an edge 68*a* of region 51*a* rising wholly vertically to the top margin 21*a* of front surface 20*a*.

The region 52*a* is a right front region disposed on surface 20*a* rightward of right front lead 28*a* and extending down to a termination 70*a* of the region at the bottom margin 22*a* of the surface 20*a*. The region 52*a* has an angulated edge 71*a* separated by a gap 72*a* from the upper edge 41*a* of the lead 28*a*. At a point above the junction, at strip end 37*a*, of that lead with central strip 26*a*, the edge 71*a* intersects with an edge 73*a* of region 52*a* rising wholly vertically to the top margin 21*a* of front surface 20*a*. The vertical edges 68*a* and 73*a* of, respectively, regions 51*a* and 52*a* and the upper horizontal edge 34*a* of central strip 26*a* define and bound on surface 20*a* a relatively large bare area 75*a* above the central strip.

The coupler assemblage 11 has formed therein a plurality of plated-through holes or vias of which ones are designated in FIG. 2 as holes 80–89 and others as holes 90–98 while still others remain undesignated. Hole 89 lies on, or approximately on, the vertical axis 32 of board 15, and holes 80–88 and 90–98 lie, respectively to the left and right of that axis. Holes 80–88 and 90–98 are, or are approximately symmetrically distributed relative to axis 32. That is, holes 85 and 95, say, are or are approximately, at the same height and are equidistant from axis 32, the same is true of holes 87 and 97, and so on. Each of holes 80–89 and 90–98 and the undesignated holes has a front opening in one of the front ground plane regions 50*a*, 51*a*, 52*a*, and each such hole passes transversely from that opening and region through board 15 and then through a metallic back ground plane region (later described in more detail) on the back surface 20*b* of the board to a back opening of such hole in that back ground plane region. Further, the interior bounding wall provided for each hole by the dielectric material 16 of board 15 is coated with copper to provide a conductive path for electricity through that hole. Thus, each of plated-through holes 80–89 and 90–98 and the undesignated holes electrically connects a metallic ground plane region on the front of board 15 to a metallic ground plane region on the back of the board. More details will be later given of such connections.

Figure 3:
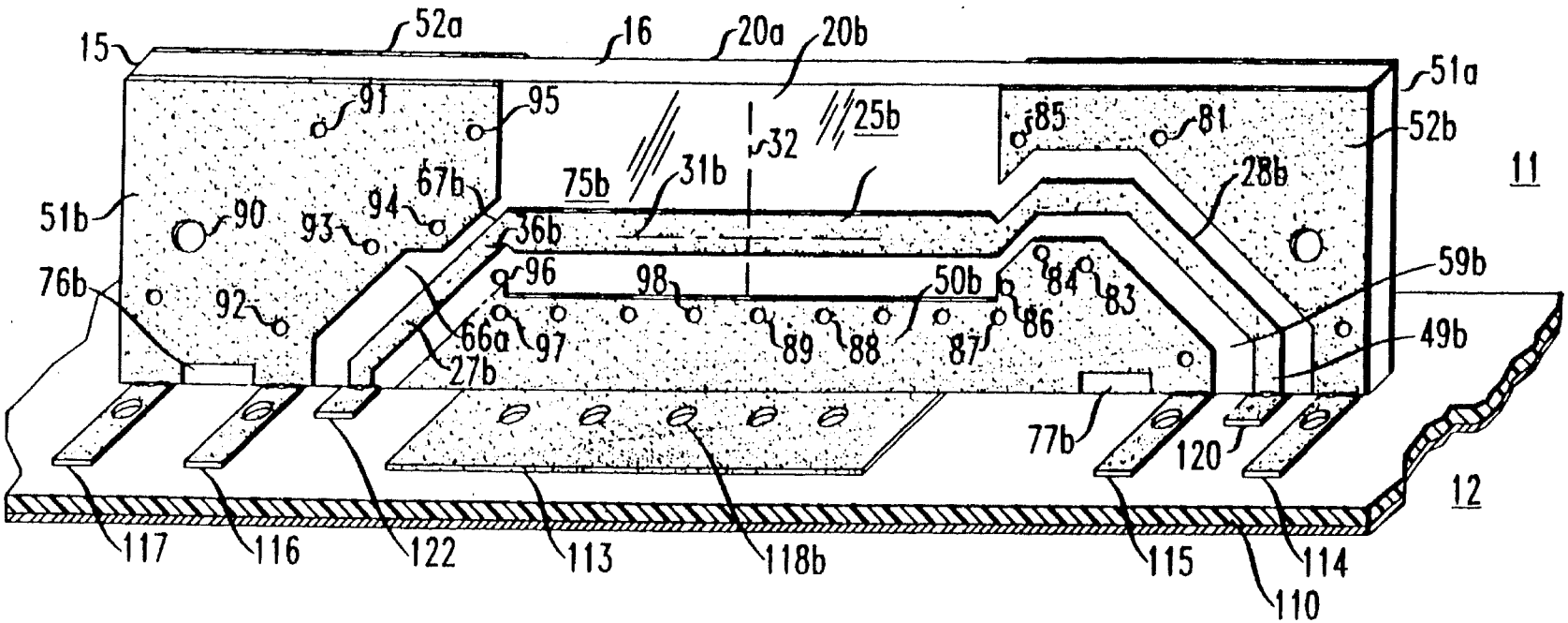
FIG. 3 is an isometric view of the back side of the FIG. 1 device.

The coupler assemblage 11 is mounted on the top of connector assemblage 12 and stands vertically up from that latter assemblage. That connector assemblage comprises a connector substrate or body of dielectric material which in device 10 takes the form of a mother or support board 110 having lower and upper surfaces 108, 109. The connector or support board 110 and the coupler board 15 together provide an insulative base unit for carrying the metallic elements of the directional coupler device 10. The board 110 has on its bottom surface 108 a metallic layer 112 which may be formed, say, of copper clad on that surface and which provides the main ground plane region on board 110. The board 110 also, has, however, on its upper surface 109 a central rectangular expanse provided by a layer of copper coated on that upper surface and providing a supplemental ground plane region 113. The longitudinal extent of that region is preferably as shown in FIG. 3 rather than FIG. 2.

Similar smaller supplemental ground plane regions 114, 115 and 116, 117 are provided to the left and right of, respectively, the central supplemental ground plane region 113. The upper ground plane regions 113–117 of board 110 are electrically connected to its lower ground plane region 112 on the front side of device 10 by plated-through holes 118a passing through board 110 to the front of the vertical coupler assemblage 11.

For purposes of electrically connecting the coupler assemblage 11 to 109 of the board. The four strips 120, 121,122 and 123 register at the front side of circuitry external to device 10, the support board 110 has four parallel metallic connector strips 120, 121,122, and 123 extending transversely on the upper surface coupler assemblage 11, and in its longitudinal dimension, with, respectively, the center of void 76*a*, the termination 29*a* of the lead 27*a* of strip conductor 25*a*, the center of void 77*a*, and the termination 49*a* of the lead 28*a* of strip conductor 25*a*. Because connector strips 120 and 122 are isolated by voids 76*a* and 77*a* from the ground plane regions 51*a*, 50*a* on the front side of coupler board 15, those strips can and do pass beneath the front side of the board 15 without being grounded by coming into contact with one of those ground plane regions.

The connector strips 121 and 123 are, however, not so electrically isolated from the coupler board 15 on its front side. Rather those connector strips 121 and 123 are electrically connected by solder beads 125*a* and 126*a* to, respectively, the terminations 29*a* and 49*a* of the left and right front leads 27*a* and 28 of the front strip conductor 25*a*. Other solder beads 130*a* are used to electrically connect the front ground plane regions 50*a*, 51 a, and 52*a* on the coupler board 15 to the ground plane regions 113–117 on the upper side of support board 110.

Turning now to FIG.3 which shows the back side of device 10, the back surface 20*b* of the coupler board 15 has thereon (a) a flat elongated metallic conductor 25*b* comprising, as portions thereof, a back central strip 26*b* and two back leads 27*b* and 28*b*, and (b) metallic expanses 50*b*, 51*b* and 52*b* constituting respective back ground plane regions on that back surface. The back surface 20*b* and the elements 25*b*–28*b* and 50*b*–52*b* are (as will be apparent from a comparison of FIGS. 2 and 3) substantial duplicates of their counterpart elements on the front side of board 15. There is, however, an important difference in the nomenclature used herein to describe such elements which are, respectively, on the front side and the back side of the board. That is, it was earlier stated that the front-to-back transverse direction will be used herein as a reference direction in describing left-relations between elements of the coupler device 10. Using that front-to-back direction as the criterion for determining which elements are "left" and "right" in relation to each other, the back leads 27*b* and 28*b* are referred to herein as right and left back leads, respectively, even though they appear to have the opposite handedness in FIG. 3 (but not in FIG. 4). Similarly, the back ground plane regions 51*b* and 52*b* are referred herein as being right and left back ground plane regions although they appear to have the opposite relation in FIG. 3 (but not in FIGS. 1,2 and 4). The same approach to the left-fight relation is used for other elements shown in FIG. 3.

Some differences of the back side of device 10 from its front side are as follows. In FIG. 3, the connector strips 122 and 120 on support board 110 are terminated on the back side of device 10 by stub lengths of those connectors which are electrically connected by solder beads 126*b* and 125*b* to the terminations 49*b* and 44*b* of, respectively, the left back lead 28*b* and right back lead 27*b*. The various solder beads 125, 126 and 130 on the front and back sides of board 15 provide mechanical bonds by which the coupler assemblage 11 is fastened to the support assemblage 12.

Referring back to FIG. 1, the coupler device 10 is shown as being connected at its front side to circuitry 134 external to the device. Specifically, the connectors strips 121 and 123 are shown as electrically connecting the left and right hand ends of the strip conductor 25*a* to, respectively, the elements belonging to external circuitry 134 of (a) a 50 ohm source 135 of microwaves, and (b) a circuit means 136 offering a 50 ohm resistance seen by that conductor at its right hand end. The strips 120 and 122 electrically connect the left and right hand ends of the strip conductor 25*b* to elements of circuitry 134 consisting of, respectively, (c) a 50 ohm termination 137 of that conductor at its left hand end, and (d) a 50 ohm load 138 for the microwave energy transferred from conductor 25*a* to conductor 25*b*. Thus, the connector strips 121, 123, 122 and 120 on the support board 110 serve to provide for the entire device 10 the signal ports known as, respectively, the input port, the thru port, the isolation port, and the coupled forward port. Considering, however, the coupler board 15 alone (i.e., without the assemblage 12), the lead terminations 29*a*, 49*a*, 29*b* and 49*b* provide, respectively, for the board device its input port, thru port, isolation port and coupled forward port.

Because any of the connector strips 120–123 can pass beneath coupler assemblage 11 and, in so doing, be protected by one of the notch-shaped voids 76*a*, 76*b*, 77*a*, 77*b* from being grounded by contact with one of the ground plane regions on that assemblage, any of those connector strips can extend on support board 10 (beyond a stub length of the strip) away from the coupler board 15, either in the front-to-back transverse direction or the back-to-front transverse direction. Thus, the coupler device 10 is flexible in its connectability in that it is not limited to being electrically connected to external circuitry on only the front side (or only the back side) of the device. As just one example of that flexibility, in lieu of what is shown by the figures, connector strip 123 may extend, from a stub length thereof on the front side of board 15, beneath the board 15 and notch-shaped void 76b and thence on support board 10 rearward to an electrical connection of that strip with the external circuit element 136 located to the rear of device 10. Also, connector strip 120 may extend on support board 110, away from coupler board 15, rearward to an electrical connection of strip 120 with the external circuit element 138 located to the rear of device 10. Device 10 has that versatility in its connectability to external circuitry because, as stated, any of connector strips 120–123 can pass beneath board 15 and, in so doing, are protected by the notch-shaped voids 76, 77 on board 15 from being grounded.

Some features of the coupler assemblage 11 not yet mentioned are as follows. The dielectric material 16 of the board 15 is a ceramic filled polytetraflouroethylene material with a dielectric constant of 10.5. The thickness of the dielectric material is 0.025" and the metallic layers on the transversely opposite sides of board 15 are provided by ½ OZ. copper cladding. Originally those layers completely coated both of those sides of the board, but such originally continuous layers have been etched to form the flat conductors and ground plane regions on such sides.

The central strips 26 on board 15 have a longitudinal length of 0.8" and a width of 0.05" and are spaced from the near edges 55 of the central ground plane regions 50 by strip-bordering gaps 58 having a width of 0.07". The leads 27 and 28 of the strip conductors have a width of 0.023". The strip conductors 25 and ground plane regions 50–52 on board 15 have thereon an anti-oxidant coating (not shown) which may be gold or a tin-lead composition or other composition.

Some other dimensions and values are now given. As shown in FIGS. 2 and 3, the lead-bordering gaps 57 and 66 and the lead-bordering gaps 59 and 72 to either side of, respectively, the front and back leads 27 and the front and back leads 28 are gaps which (except where, narrowed to the described pinches 67 and 61, of respectively, gaps 66 and 59) are substantially greater in width than such leads. It follows that, since those leads have a width of 0.023" which is about the same as the 0.025" thickness of the coupler board 15, FIGS. 2 and 3 disclose that the mentioned gaps have (except at their pinches, if any) a width value substantially greater than the thickness value of the board. In point of fact, the gaps 57 and 72 and the gaps 66 and 59 (except at their pinches 67 and 61 ) have a width of 0.050" which is twice the 0.025" thickness of the boards. At their pinches 67 and 61, the gaps 66 and 59 have widths which are in the range from 0.0005" to 0.010", and which are smaller in value than the board thickness.

The overall length of the board is about 1.875", and the overall width of the board is about 0.485". Board 15 is thus less than half as high as it is long.

Figure 4:
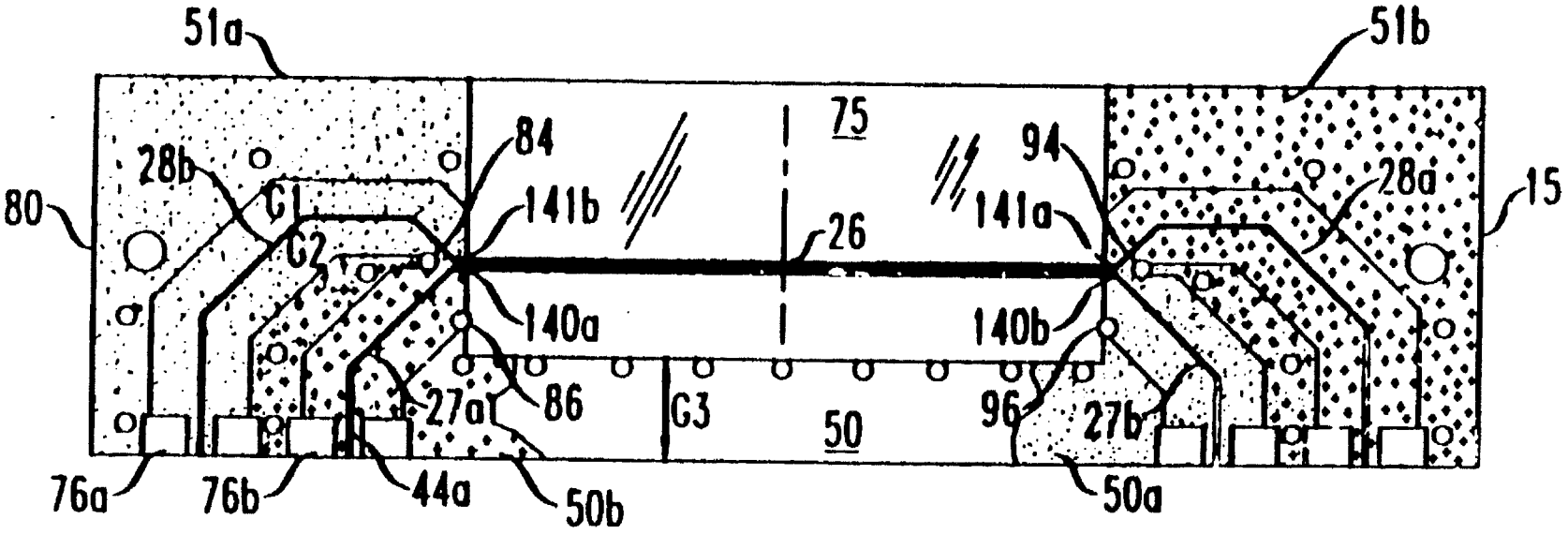
FIG. 4 is a front schematic, elevational view, taken as indicated by the arrows 4—4 in FIG. 1, which is a superposition of respective elevational views which would be seen of the front and back sides of the coupler assemblage, if the viewer were to look, in the front-to-back transverse direction, towards, through and past such assemblage.

Reference is now made to FIG. 4 for a showing of mechanical and electrical characteristics of the assemblage 11 which contribute to its functioning as a microwave directional coupler. FIG. 4 is schematic in the respect that the configuration for some of the elements shown thereby (as, for example, the flat conductor lead portions 27 and 28) differs somewhat from the configuration shown by FIGS. 2 and 3 for those same elements. To the extent that there are such differences, FIGS. 2 and 3 show the preferred configuration.

In FIG. 4, areas on the FIGURE which are only stippled represent only areas of ground plane regions on the front side of coupler board 15, areas on the FIGURE which are only filled with small crosses represent only areas of ground plane regions on the back side of coupler board 15, and areas on the FIGURE which are both stippled and contain small crosses represent areas of overlap through the thickness of board 15 between ground plane regions 51*a* and 50*b*, and between ground plane regions 50*a* and 51*b*.

Considering now the elongated longitudinally extending horizontal bar represented by cross hatching and designated in FIG. 4 by the reference numeral 26, that bar represents both the front central strip 26*a* of strip conductor 25*a* (FIG. 2) and the back central strip 26*b* of the strip conductor 25*b* (FIG. 3). Those two central strips lie in parallel planes and register with each other through the thickness of the substrate provided by board 15. In such connection what is meant herein by the statement that two elements on opposite front and back sides of a substrate (exemplified by board 15) are "in registration through the thickness of the substrate" (or a similar statement such as that the two elements are "overlapping through the board") is that, if the area occupied by the front element over the front side of the substrate is projected through the substrate to its back side to form on such back side an image of such front side area, the area of such image will fully or partly overlap with the actual area occupied over such back side by the back element. In the case of the substrate exemplified by board 15 which has in the transverse direction front and back sides which are parallel and planar and spaced from each other by a constant thickness of the substrate, the direction of projection taken from any point within the front side area (in order to form the mentioned image of that area) is a direction which coincides exactly with such transverse direction. In other cases, however, (e.g., where the front and back sides of the substrate are planar but non-parallel (or one or both are non-planar) the projection from any point within the mentioned front side area to the substrate's back side in order to form the mentioned image is effected in the direction through the substrate which yields, between that point and the corresponding point on the image, the smallest thickness of the substrate as measured by the distance between those two points.

The central strips 26*a* and 26*b* are, by virtue of being in full registration through the thickness of board 15, broadside coupled with each other, electromagnetically speaking. Moreover, each of those central strips is electromagnetically coupled with both of the central ground plane regions disposed below those strips on the board. That is, front central strip 26*a* is, by a quasi-coplanar wave guide effect, coupled through the dielectric material of board 15 to back central region 50*b* and, also, is coupled, partly through that material and partly by a coplanar wave guide effect to the front central region 50*a*. The back central strip 26*b* is coupled in a similar manner, both to the front central region 50*a* and the back central region 50*b*.

If desired, the front and back surfaces 20*a*, 20*b* of board 15 may have additional ground plane regions thereon provided by metallic expanses (not shown) in the form of rectangular bars extending on front and back surface areas 75*a*, 75*b* between the shown left and right ground plane regions 51 and 52, such bars being integrally joined with those shown regions, and being spaced by gaps from the central strips 26*a*, 26*b* lying below them. Such additional ground plane regions will, if present, increase the coupling between the strips 26*a*, 26*b* and ground with the possible concomitant, however, of diminishing the coupling between those strips themselves.

Turning now to the leads for the flat conductors 25*a*, 25*b* and considering first the left hand leads 27*a*, 28*b*, those leads follow respective paths which diverge on board 15 from each other, outward from the junctions, at the strip ends 36*a*, 37*b* of those leads, with strips 26*a*, 26*b*. The result is that, outward of those strip ends the lead 27*a* and its associated line-bordering gaps 57*a*, 66*a* to either side of that lead are non-overlapping through the thickness of board 15 with the lead 28*b* and its associated line-bordering gaps 72*b*, 59*b* to either side of lead 28*b* and, thereafter, diverge more from each other for a while, and never come into overlapping relation. Such divergence of the respective paths of the left leads 27*a* and 28*b* permits, however, each of those leads over most of its length to be in full registration through the thickness of the board with an area of a ground plane region on the opposite side of the board. That is, and as shown in FIG. 4, the left lead 27*a* on the front of board 15 overlaps through the board with an area of ground plane 50*b* on the back of board 15 for the lead's full length except for a small portion of such lead at its termination 29*a* and for another short portion 140*a* of that lead near its junction 36*a* with central strip 26*a*. Similarly the left lead 28*b* on the back of board 15 is in full registration through the board with an area of left front ground plane region 51*a* except for a small portion of such lead at its termination 49*b* (FIG. 3) and for another short portion 141*b* of that lead near its junction 37*b* with central strip 26*b*.

Accordingly, each of the left lead portions 27*a* and 28*b* (of strip conductors 25, 25*b* ) on the front and back side, respectively, of board 15 is, over most of its length, in registration through the thickness of the board with a ground plane region on the opposite side of the board so as to have with that region a broadside coupling akin to that existing in microstrip transmission line. The end portions 140*a* and 141*b* of those leads do not, however, overlap through the thickness of the board with any area of any ground plane region. That is so of necessity because the only way for such overlap to be produced would be, in the case of lead portion 140*a* to have the head 60*b* (FIG. 3) of back central ground plane region 50*b* modified to join back central strip 26*b* at junction 37*b* and, in the case of lead portion 141*b*, to have left front ground plane region 51*a* (FIG. 2) modified to join front central strip 26*a* at junction 36*a*, but either such joinder would ground the "joined-to" central strip to render the coupler device 10 inoperable.

The inability to broadside couple the mentioned lead portions 140*a* and 141*b* with ground plane regions on the opposite sides of board 15 is compensated for by, in the case of portion 140*a*, providing on the front side of board 15 (FIG. 2) in the gap 66*a* the pinch 67*a* between lead 27*a* and left ground plane region 51*a*, and by, in the case of portion 141*b*, providing on the back side of board 15 (FIG. 3) and in the gap 59*b* the pinch 61*b* between the lead 28*b* and the head 60*b* of the back central ground plane 50*b*. Because of the narrow widths of those pinch gaps 67*a* and 61*a* the left front lead 27*a* over its end portion 140*a* becomes coupled by a coplanar wave guide coupling with the front left ground plane region 51*a* on the same side of board 15 as that lead, and the left back lead 28*b* over its end portion 141*b* becomes coupled by a coplanar wave guide coupling with the back central ground plane region 50*b*.

What has been set out above regarding the left lead portions 27*a* and 28*b* of the flat conductors 25*a* and 25*b* applies equally, mutatis mutandis, to the right lead portions 28*a* and 27*b* for those strip conductors. That is, those right lead portions follow divergent paths to result in being non-overlapping through the thickness of the board at a short distance from their junctions with their corresponding strips 26*a* and 26*b*, and by remaining so non-overlapping thereafter. Further, the right front lead 28*a* is, over most of its length, in registration through the thickness of board 15 with an area of the ground plane region 51*b* on the back of the board, and the right back lead 27*b* is, over most of its length, in registration through the thickness of the board with an area of the front central ground plane region 50*a*. The right leads 28*a* and 27*b* are thus broadside coupled over most of the length of each with a ground plane region on the opposite side of the board from that lead.

Those leads 28*a* and 27*b* have, however, end portions 141*a* and 140*b* near the junctions of those leads with central strips 26*a* and 26*b*, and which end portions 141*a* and 140*b* (a) are separated by narrow pinch gaps 61*a* and 67*b* from, respectively, the front central ground plane region 50*a* and the back ground plane region 51*b*, and (b) are respectively coupled by coplanar wave guide couplings to those ground plane regions 50*a* and 51*b* on the same side of board 15 as, respectively, such lead portions 141*a* and 140*b*.

The plated-through holes 80–89 and 90–98 (and the other plated-through holes shown by the drawings), perform the useful electrical function of shortening the return paths for R.F. currents flowing through the ground plane regions. For example, the holes which extend in a row just below the upper edges 55 of the central ground plane regions 50 (and which holes include holes 87–89 and 97) permit R.F. current produced near those upper edges by the field coupling of those regions with central strips 26*a*, 26*b* to flow close to those edges between front region 50*a* and back region 50*b* without having to be detoured down to the supplemental ground plane 113 on mother board 110 in order to effect such current flow between the edges of those regions.

From the example given, it will be evident that the plated-through holes in board 15 electrically interconnect the ground plane regions on the board independently of any connection of any of those regions to the supplemental ground planes 113–117 on the top of support board 110. Such interconnection of the ground plane regions on board 15 by plated-through holes in the board itself serves to shorten considerably the return paths for R.F. currents in those regions (as compared to the lengths those paths would have if such regions on board 15 could be interconnected only through the ground plane regions on support board 110) and, thereby, to reduce losses in, and otherwise promote the efficiency of, the coupler device 10.

It will be appreciated from the foregoing description that the coupler device 10 comprises a pair of two-conductor transmission lines, each including signal conductor means and ground conductor means, of which respective signal conductor means for those two lines are provided by the flat conductors 25*a* and 25*b* on opposite surfaces of the substrate means 15 for the device 10, and of which the ground conductor means for those lines are provided by ground plane regions, such two transmission lines having portions which are electromagnetically coupled with each other to effect transfer of microwave energy from one to the other of such lines. The provision in the coupler device of having ground plane regions on the same surfaces of the coupler substrate or body of the device as are the mentioned flat conductors is a feature which conserves the materials required to be included in the coupler in order to realize a desired functioning thereof, and which, moreover, promotes the ease and inexpensiveness of manufacture of the coupler device.

Figure 5:
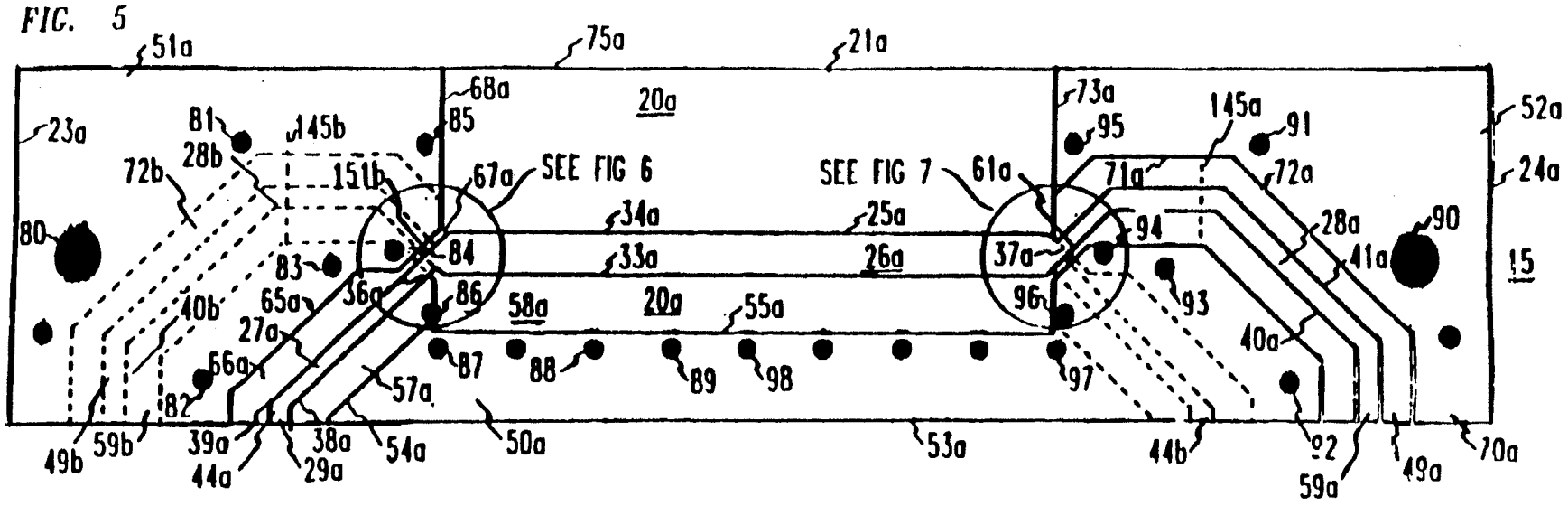
FIG. 5 is a "see-through" front elevation view which is like FIG. 4, but in which elements on the front and back sides of the coupler assemblage are shown by, respectively, solid lines and dash lines.

To describe further some of the features of the coupler device 10, it will be noted from FIGS. 4 and 5 that the full lengths of the various leads on board 15 extend from their junctions with their corresponding central strips to the ports at which those leads terminate at the bottom margin of the board. The left front and back leads 27*a* and 28*b* are unequal in length and, likewise, the right front and back leads 28*a* and 27*b* are unequal in length. Such inequality in length facilitates a layout for the paths followed by the leads which will enable them to extend from such junctions to such ports without any lead, over at least most of its extent, having any overlap through the board with any other lead.

The fiat conductors 25*a* and 25*b* have the same overall lengths. Those lengths are measured for conductor 25*a* between the ports 29*a* and , 49*a* and, for conductor 25*b*, between the ports 29*b* and 49*b*. It is preferable (although not necessarily) desirable that, in a hybrid coupler, the two conductors which are coupled together have such equal overall lengths in order, if nothing else, to simplify the work of designing the coupler.

In order, however, to attain both of the desirable features of having the conductors 25*a* and 25*b* equal in overall length and, concurrently, having unequal the lengths of the left leads as to each other and the length of the right leads as to each other, it is necessary that, in each of the conductors 25*a* and 26*b*, the left and right leads therein have respective lengths unequal to each other, as is the case with those conductors. Such inequality leads, of course, to the feature that, on board 15, the longitudinal centers 32 of the central strips 26 do not coincide with the respective midpoints 145*a*, 145*b* of the overall lengths from port to port of the conductors 25*a* and 26*b*. Instead, the strip centers 32 are offset from such midpoints which, as shown in FIG. 5, have a location on the longer lead 28 of the two leads included in each of the fiat conductors 25. I have found that to have such broadside coupled portions 26 of the coupled conductors 25 not at the midpoints 145 of the overall lengths of such conductors is an asymmetry which produces no significant adverse effect on the operation of the coupler.

To have the leads on the coupler board be unequal as described above is often advantageous in that, for example, it permits greater freedom of design of the layouts on the board of the leads and the ground plane regions. It is not, however, required by the invention, considered broadly, that there be present any of the described lead inequalities.

Figure 7:
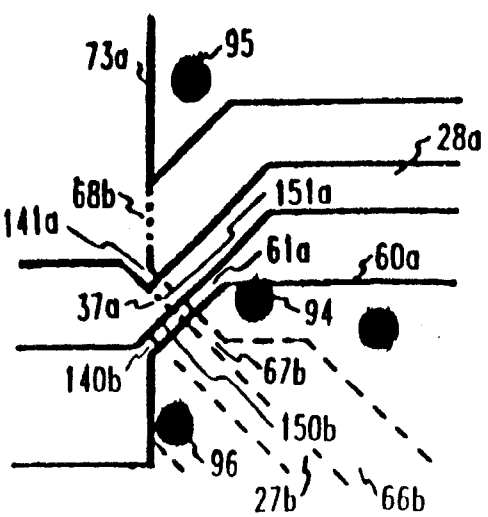
FIG. 7 is an enlarged view of the circled right-hand portion of FIG. 5.

Considering now in further detail the central strips 26*a* and 26*b*, the end portions 36*a* and 37*a* of strip 26*a* have the shapes (FIGS. 2, 6, 7) of congruent isosceles triangles having their vertex angles pointing away from the longitudinal center of the strip. Also, the end portions 36*b* and 37*b* of strip 26*b* have the shapes of isosceles triangles (FIG. 3) which have their vertex angles pointing away from the center of strip 26*b*, and which are congruent with each other and the triangles formed by portions 36*a*, 37*a*. The triangular portions 37*b* and 36*b* of strip 26*b* are directly behind, through the board in the front-to-rear transverse direction, with, respectively, the triangular portions 36*a* and and 37*a* of strip 26*a* so that there is no point within any of those triangles which does not overlap through the board with a corresponding point in another of those triangles. Thus, those triangular portions partake in the broadside coupling together of conductors 25*a*, 26*a* through their central strips 26*a*, 26*b*. Such full overlapping within the triangular portions 36*a*, 37*b*, 37*a*, 36*b* does not occur outward of those portions in the direction away from the centers of strips 26*a*, 26*b*.

Figure 6:
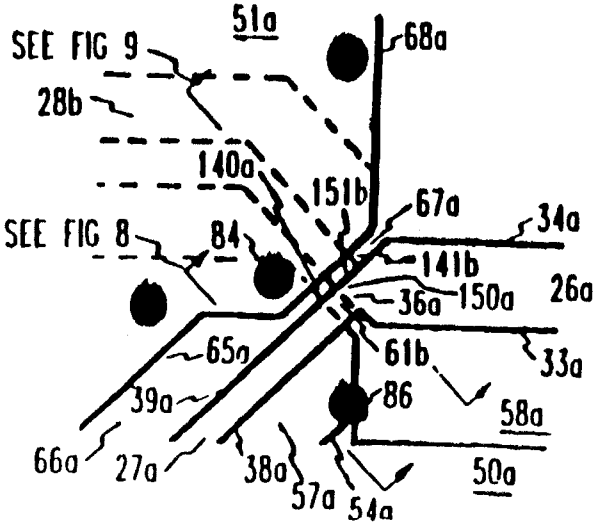
FIG. 6 is an enlarged view of the circled left-hand portion of FIG. 5.

Referring to FIG. 6, on the front surface of the board, the lead 27*a* has a junction 150*a* with the lower side of the triangle defined by strip end portion 36*a*, the location of such junction being indicated by a dash line. With regard to the transmission line provided by conductor 25*a* on the front surface of the board and the metallic portion opposite it on the back surface of the board, the signal conductor 27*a* extends continuously to strip 26*a* but the ground conductor provided by the portion opposite conductor 27 a of region 50*b* does not extend all way on the board's back surface to strip. 26*b*. That is so because the gap 61*b* which borders lead 28*b* separates that portion of ground plane region 50*b* from strip 26*b* and, also, is opposite through the board with the end portion 140*a* of lead 27*a* and determines the length along conductor 25*a* of portion 140*a*, which length is equal to the width of gap 61*b*. Because the microstrip coupling of conductor 25*a* is, by definition, with grounded metallic portions on the opposite side of board 15, such microstrip coupling ends, technically speaking, at the edge of gap 61*b* away from the central strip 26*a*. Notwithstanding such ending, the transmission line provided by conductor 25*a* and metallic portions on the board's back surface 20*a* will not have an "open" looking toward strip 26*a* when the line reaches gap 61*b* since electric field lines from lead end portion 140*a* can bridge that gap to terminate on central strip 26*b*, and that strip while not grounded, is broadside coupled with central strip 26*a* to provide by the two strips a continuation beyond lead 27*a* of the transmission line including signal conductor 25*a*. The presence, however, of gap 61*b* existing between strip 26*b* and the portion of ground plane region 50*b* opposite lead 27*a* introduces into such transmission line an electrical and mechanical discontinuity which, if not compensated for, would produce an anomaly in the impedance of the line.

Similar discontinuities exist between the transmission lines provided by the other leads on the board and the portions opposite them of ground plane regions on the other side of the board from those leads. Specifically, lead 28*b* on the back surface of the board has a junction 151*b* (FIG. 6) with the upper side of the triangle defined by end portion 37*b* (FIG. 3) of strip 26*b*, but the portion of ground plane region 51*a* opposite lead 27*b* on the front surface of the board is separated, from the upper side of the triangle defined by end portion 36*a* of strip 26*a*, by the gap 67*a* which is opposite the end portions 141*b* of lead 27*b* and determines the length along lead 28*b* of portion 141*b* because such length equals the width of gap 67*a*. Further, on the right hand side of board 15, lead 28*a* (FIG. 7) has a junction 15 1a with the upper side of the triangle defined by strip end portion 37*a*, but the portion of region 51*b* which though the board is opposite lead 28*a* is separated by gap 67*b* from the upper side of the triangle defined by end portion 37*b* (FIG. 3) of strip 26*b*. Still further, lead 27*b* has a junction 150*b* (FIG. 7) with the lower side of the triangle defined by strip end portion 37*b*, but the portion of region 50*a* which, though the board, is opposite lead 27*b* is separated by gap 61*a* from the lower side of the triangle defined by strip end portion 37*a*.

Thus, the lines, provided by leads 27 and 28 and the ground plane regions opposite them through the board, have the discontinuities just described in such lines. This discontinuities are, however, compensated for in a manner which is the same for all the transmission lines, but which is exemplified by the line including lead 27*a* now to be considered.

Referring to FIGS. 4 and 5 and considering the portion of lead 27*a* designated as section 44*a*, for a small distance extending from the bottom margin 22 of board up to the top of void 77*b*, the front lead 27*a* is absent a ground plane region portion opposite it through the board, and such absence can, if desired be compensated for by utilizing the expedient of narrowing over that distance the gaps 57*a*, 66*a* to either side of lead 27*a*, down to very small widths as suggested by the FIG. 4 showing. It has been found, however, that it is unnecessary to resort to such expedient for purposes of avoiding an anamalous impedance in the transmission line, and that such narrowing of the gaps 57*a*, 66*a* sometimes creates difficulties in preventing grounding of the solder connection made between lead 27*a* and connector strip 121 (FIG. 2). Hence, it has been found preferable not to employ such expedient, and to provide that gaps 57*a*, 66*a* have their full widths at the very bottom 22 of the coupler board.

Figure 8:
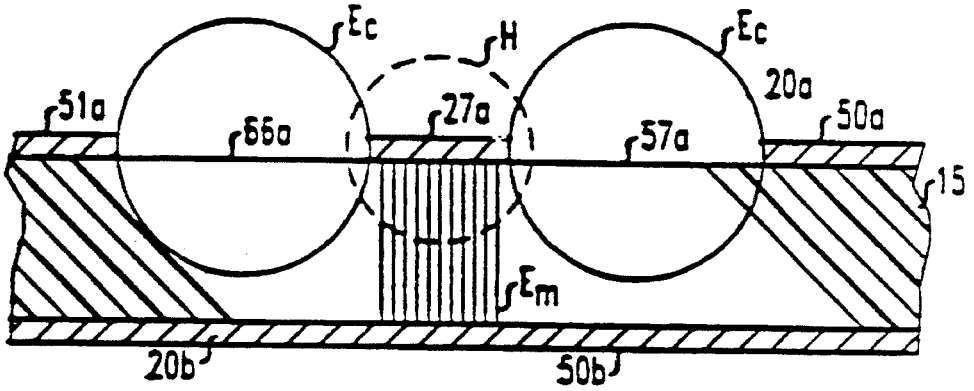
FIGS. 8 and 9 are fragmentary enlarged cross-sectional views, taken as indicated by, respectively, the arrows 8—8 and 9—9 in FIG. 5, of portions of the FIG. 1 coupler assemblage as such portions would be seen if the coupler board of the assemblage were to be horizontal with its front surface being on top, such figures being schematic representations of operating characteristics of such assemblage and not being to scale, and the showings of which are not to be taken as necessarily being quantitatively accurate.

Whether or not such expedient is adopted, the gaps 57*a* and 66*a* bordering lead 27*a* will have their full widths over a greater extent of the full length of lead 27*a* as one proceeds from the end of that lead at port 29*a* to the junction 150*a* of that lead with central strip 26*a*. The presence over that extent of the lead 27*a* itself, the dielectric board 15, the regions 51 a and 50*a* in the same plane as lead 27*a* and the gaps 66*a*, 57*a* provide, together, the structure which is shown in FIG. 8, and which has the elements necessary to create a double-sided coplanar wave coupling for transmitting microwaves along the lead in the instance where it mostly overlaps through the board with portions of ground plane regions on the opposite side of the board. Whether or not, however, such elements are sufficient to create such a coupling depends on the effect of a number of factors including the dielectric constant of the material of the board, the width of the lead in relation to the board thickness (which determines the distance of the lead from the ground plane region 50*b* on the opposite side of the board) and, as an important parameter here, the ratio of the widths of gaps 66*a* and 57*a* to the board thickness which determines that distance. An increasing of those gap widths in relation to such thickness tends to inhibit the creation of an effective coplanar wave guide for microwave transmission, the converse being true for a decreasing of such gap widths in relation to such thickness. As an empirical rule, in order to insure that microwave transmission over that greater extent of lead 27*a* will at least be primarily by microstrip wave guide coupling as compared to coplanar wave guide coupling, the widths of gaps 66*a* and 57*a* should be enough greater than the thickness of board 15 to yield that result when other factors are taken into account. As stated the gaps 66*a* and 57*a* have, over at least most of their extents, a width which is twice the board thickness, and that ratio causes, in the case of board 15, the transmission of microwaves over such extents of the leads to be substantially entirely by a microstrip wave guide coupling of the leads as will now be described.

FIG. 8 depicts the operating characteristic of the coupler device 10 that over such greater extent of lead 27*a* (and all the other leads). Specifically the transmission of microwaves over such greater extent of that lead is substantially entirely by a microstrip wave guide coupling of lead 27*a* to ground plane region portions on the opposite side of the board, as distinct from a coupling of lead 27*a* to regions 50*a* and 51*a*. That is, any microwave electromagnetic field in the coplanar mode is very feeble as represented in FIG. 8 by the connection shown therein of leads 27*a* to each of regions 50, 51*a* by only one coplanar electric field line designated $E_c$. In comparison, over that greater extent of lead 27*a*, the transmission of microwaves along the lead takes place substantially entirely by a microstrip wave guide coupling of the lead to ground plane region 50*b*, such effective microstrip transmission being represented in FIG. 8 by a shown high density of the microstrip electric field lines designated $E_M$. That such transmission over that extent of the lead by coplanar wave guide coupling is negligible as compared to such transmission by microstrip wave guide coupling is known from the fact that the 50 ohm impedance which is calculated for the transmission line including lead 27*a* on the assumption made in designing that line that its wave guide coupling will be wholly microstrip is a calculated FIGURE which deviates by less than 5% from the measured impedance value for that line.

Some advantages of transmitting microwaves along lead 27*a* primarily by a microstrip wave guide coupling of that lead through board 15 with ground plane region 50*b* are as follows. First the width of lead 27*a* (and the other leads) can be made ten times smaller than if coplanar wave guide coupling were used. Second, the board 15 can have much less thickness than would be needed if the transmission were to be coplanar. Third, it is not necessary to be as careful about etching tolerances as if the coupling were coplanar.

Further (and as distinct from the Wong coupler in which the broadside coupled pads must each be coupled on both their lengthwise sides with coplanar ground plane regions), such microstrip coupling avoids the need for, and permits elimination of, wave guide couplings of strips 26 on their upper sides with ground plane regions above them (in addition to the described couplings of those strips on their lower sides with the ground plane regions 50 below them), and the elimination, as shown, of such couplings of strips 26 on their upper sides permits the height of board 15 to be reduced and a cost saving effected thereby.

Figure 9:
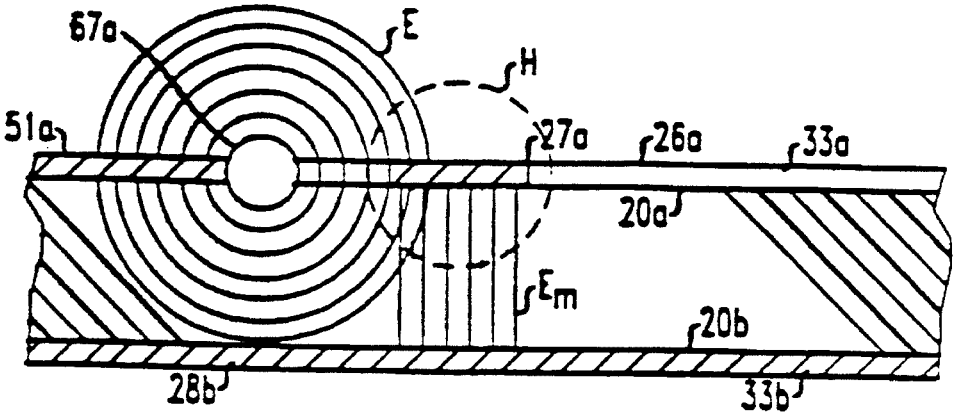

As was mentioned earlier, the discontinuity caused in the transmission line including lead 27*a* by the gap 61*b* would, if left alone, produce an anomaly in the impedance of the line. Such possible problem caused by that discontinuity is overcome on board 15 by having the mode of microwave transmission along the full length of lead 27*a* shift from transmission substantially entirely by microstrip wave guide coupling over a greater extent of lead 27*a*, to microwave transmission, over a lesser extent of lead 27*a* adjacent its junction 150*a* with strip 26*a*, and a significant part of which transmission is effected by coplanar wave guide coupling. Such transition from one to the other mode of transmission along lead 27*a* is depicted in FIG. 9 and is implemented, as earlier described, by narrowing the gap 66*a* down from its width shown in FIG. 8 to the width which it has in the pinch 67*a*, and which width is less in value than the thickness of board 15. Such narrowing of gap 66*a* causes the lead 27*a* to have to, over its lesser extent and with ground plane region 51*a* a coplanar wave guide coupling effective to transmit microwaves along the length of the lead to a degree partly or entirely compensating for the loss in effectiveness of the microstrip wave guide coupling near junction 150*a* due to the discontinuity in such latter coupling caused by the lead 27*a* having opposite it near that junction the gap 61*b* rather than a ground plane region. The occurrence of the described transition is represented in FIG. 9 by an increasing, as compared with FIG. 8, in the number of coplanar electric field lines $E_c$ and a decreasing, as compared with FIG. 8, in the number of microstrip electric field lines $E_M$. In the wave guide couplings depicted by FIGS. 8 and 9, magnetic field lines characterizing the couplings are designated by the letter H.

An interesting point with regard to the narrowing of gaps on one side of the leads on board 15 down to the described pinches in such gaps is that such narrowing is useful in two respects. That is, the narrowing of gap 66*a*, for example, down to pinch 67*a* provides a coplanar wave guide coupling for transmission of microwaves along lead 27*a* to compensate for the discontinuity caused by gap 61*b* in the transmission of microwaves along lead 27*a* by microwave wave guide coupling. At the same time, however, the presence of gap 66*a* produces a discontinuity in the transmission by microstrip coupling of microwaves along lead 28*b*, but the narrowing of gap 66*a* down to pinch 67*a* reduces the size of that discontinuity in the transmission line including lead 28*b*.

An aspect of the mentioned transition is that transmission of microwaves along lead 27 is supported by an electromagnetic field which, with advance along lead 27*a* towards strip 26*a*, shifts from being substantially entirely below lead 27*a* to being at least partly above it as shown by FIG. 9. The plated through holes aid in such shift by permitting RF currents originally generated in ground plane region 50*b* by the microstrip coupling between it and lead 27*a* to flow directly from region 50*b* to region 51*a* to there support the coplanar field formed above the latter region.

The central strip 26*a* is coupled to the ground plane region 50*a* below it (FIG. 2) and to the ground plane region 50*b* on the opposite side of board 15 by respective wave guide couplings of which the first is a coplanar coupling and the second can be referred to as a quasi-coplanar coupling inasmuch as ground plane region 50*b* is not in the plane of strip 26*a* but, on the other hand, is only slightly displaced from that plane. The plated through hole 88 and other such holes shown in FIG. 2 as extending through board 15 just below the upper edges of regions 50*a* and 50*b* serve to make more effective the coplanar and quasi-coplanar wave guide couplings of strip 26*a* to ground plane regions 50*a* and 50*b* by providing multiple metallic joinders of these regions together at their upper edges so that those regions are, in effect, seen by strip 26*a* as a single thick metallic copper body extending all the way through board 15. The same holes in like manner make more effective the coplanar and quasi-coplanar wave guide couplings (not shown) of strip 26*b* to, respectively, the region 50*b* and the region 50*a*.

From what has been said, it will be evident that the transmission of microwaves along conductor 25*a* undergoes a transition from (a) transmission primarily by microstrip coupling along lead 27*a* in which the electric fields produced by such coupling terminate on the inner or rearward surface of conductor 25*a* to (b) transmission by a coplanar wave guide coupling along central strip 26*a* in which the electric fields produced by such coplanar coupling terminate on the outer or frontward surface of conductor 25*a*. A difficulty in effecting such transition is that RF current tends to flow only on the surface of a metallic body (such as conductor 25*a*) rather than through it. The plated-through hole 86, however, aids in such transition in a manner of which a simplified explanation is as follows.

Assume that, at a point along lead 27*a* away from gap 61*b*, RF current has been caused to flow from conductor 25*a* to ground plane region 50*b* by the action of the fields produced by the microstrip coupling of that lead to that region. Such current will, in the vicinity of gap 61*b*, encounter anomalously high impedance in seeking to return to conductor 25*a* by way of the path provided by the fields existing near that gap between conductor 25*a* and the metallic portions opposite it on the boards back surface 20*b*. As, however, an alternate path of return flow to conductor 25*a*, such current may and does flow, in the back to front direction, from region 50*b* through hole 86 to the outer surface of region 50*a* to help enable and support at that outer surface the coplanar coupling of region 50*a* to strip 26*a*, such current being returned by that coplanar coupling to the conductor 25*a*. The plated-through hole 86, by virtue of permitting such RF current to pass freely from one to the other of locations on opposite sides of flat conductor 25*a*, plays an important role in enabling the wave guide coupling of conductor 25*a* to ground plane regions to shift, as described, from microstrip coupling to coplanar coupling.

The plated-through hole 96 performs analogous function to that just described for hole 86 in aiding the transition of microwave transmission over conductor 25*b* from transmission primarily by microstrip coupling along lead 27*b* to transmission by coplanar coupling along the strip 26*b* of conductor 25*b* .

Assume, in connection with hole 84, that, at a point along lead 28*b* displaced from gap 67*a*, RF current has been caused to flow in the rear to front direction from lead 28*b* of conductor 25*b* to ground plane region 51*a* by the fields engendered by the microstrip coupling between that lead and region. Such current will return to conductor 25*b* by passing through hole 84 in the front to rear direction to the outer surface of ground plane region 50*b* to thereby help enable and support the formation of the coplanar coupling between such ground plane region 50*b* and the central strip 26*b* of conductor 25*b*, that current being returned to conductor 25*b* by such coplanar coupling. Such passage of current through hole 84 also helps to enable and support the coplanar coupling of lead 28*b* at pinch gap 61*b* (FIG. 3) with ground plane region 50*b*.

The hole 94 performs in a similar manner, in the case of conductor 25*a*, to aid the transition of the coupling of that conductor from primarily microstrip coupling along lead 28*a* (FIG. 2) to coplanar wave guide coupling along strip 26*a* by helping to enable and support the formation of that coplanar wave guide coupling at the right hand end 37*a* of strip 26*a* of conductor 25*a* with ground plane region 50*a*. Such passage of current through hole 94 also helps to enable and support the coplanar coupling of lead 28*a* at pinch gap 61*a* with ground plane region 50*a*.

The presence of the holes 86, 94 and of the holes 84, 96 is also advantageous because a factor compensating for the mentioned impedance anomalies which, to the extent uncompensated for, will be respectively caused along the transmission lines including conductors 25*a* and 25*b* by, respectively, the gaps 61*b*, 67*b* and the gaps 67*a*, 61*a*.

As a further matter, the plated through holes disposed on board 15 longitudinally between the front and back leads 27*a* and 28*b* on the left side of the board and longitudinally between the front and back leads 28*a* and 27*b* on the right hand side of the board are holes which serve not only to electrically couple together ground plane regions on opposite surfaces of the board but, also, to prevent extraneous coupling together of the transmission lines on the longitudinally opposite sides of the holes.

The described coupler assemblage 11 has the advantages among others that, because the leads on the board and the ground plane regions thereon all have terminations at the bottom of the board 15, it is very easy to electrically connect coupler assemblage 11 to external microwave circuitry as, for example, to the connector assemblage 12. Another advantage among others of coupler assemblage 11 is that because all such terminations are on one peripheral margin of board 15, the assemblage can be compact and cheaper to manufacture than, say, the device of the Wong patent.

Some further details of the electrical characteristics of the coupler device 10 represented by FIGS. 1–3 are as follows. The described device is one which splits the input power thereto equally into two paths. This means that its thru and coupled output ports are nominally 3 dB down in power from the power supplied to the input port of the coupler. The coupler device is a 90° quadrature coupler in that the phase of R.F. energy which appears at its coupled forward port is nominally in 90° phase relation with the phase of the R.F. energy supplied to its thru port The coupler device 10 is designed for use with microwave energy having a frequency of 881 MHz ±12.5 MHz.

The above described embodiment being exemplary only, it is to be understood that additions thereto, omissions therefrom and modifications thereof can be made without departing from the spirit of the invention.

That is, the invention includes variants of the above-described embodiment which, for example, without limitation, are of the following character. The coupler substrate of the coupler device is conveniently provided by a monolithic body of dielectric material, but it may also be provided by a composite body of such material. Further, while it is convenient for the opposite surfaces of the substrate which bears the strip conductors and the ground plane regions to be parallel planar surfaces spaced from each other by a constant thickness between them of the dielectric material of the substrate, it is within the purview of the invention for such surfaces to be planar but non-parallel or for one or both of them to be non-planar. Still further, the strip conductors and ground plane regions may be provided by metallic foils on such surfaces rather than by metallic coatings deposited thereon. While the lead portions of the strip conductors have been described as narrower in breadth than the central strip portions thereof, they need not be narrower than such central strip portions. The foregoing are only a few examples of particular forms of dielectric coupler devices which are covered by the invention hereof.

Accordingly, the invention is not to be considered as limited save as is consonant with the recitals of the following claims.

I claim:

1. A microwave coupler device comprising: a horizontally and vertically extending dielectric coupler board having a longitudinally horizontal bottom margin, thickness in the transversely horizontal dimension, and front and back surfaces separated by said thickness, front and back fiat elongated metallic conductors on said front and back surfaces and respectively comprising front and back central strips centrally located on said board and registering with each other through said board to be broadside coupled with each other, said strips each extending longitudinally between opposite ends thereof which are left and right ends in the front-to-back traverse direction, said front and back conductors further comprising: two front leads in said front conductor which are left and right leads having junctions with, respectively, said left and right ends of said front strip, and two back leads in said back conductor which are left and right leads having junctions with, respectively, said left and right ends of said back strip, said two front leads and two back leads having, respectively, two front and two back terminations extending downwardly to lower ends thereof constituting respective ports disposed on said board's front and back surfaces at said bottom margin, the two ports at said margin on each of the front and back surfaces of said board being longitudinally spaced at said bottom margin from all the other of said ports, said front and back conductors having overall lengths extending from one to the other of the two ports constituting respective pairs thereof on, respectively, said front surface and said back surface, and said device further comprising: a plurality of front metallic ground plane regions on said front surface and spaced thereon from, respectively, said front leads and said front strip by front lead-bordering gaps on either side of each of said front leads, and by a front strip-bordering gap below said front strip, and a plurality of back metallic ground plane regions on said back surface and spaced thereon from, respectively, said back leads and said back strip by back lead-bordering gaps on either side of each of said back leads, and by a back strip-bordering gap below said back strip, said front ground plane regions and back ground plane regions having respective terminations on, respectively, said front surface and back surface which are disposed at said bottom margin to each be longitudinally spaced at said margin from the other and from each of said downwardly extending terminations of the two leads on that surface, said flat conductors and adjacent portions of said ground plane regions providing transmission lines, inclusive of the leads and strip in each such conductor, for conveyance of microwaves between the ports at the opposite ends of such conductors, and said leads and ground plane regions on each of said surfaces being mutually disposed so that all said leads over at least most of their lengths are non-overlapping through said board with any other lead while being overlapping through said board with portions of ground plane regions on the opposite side of said board.

2. A coupler device according to claim 1 in which said left front and back leads are unequal in length and said right front and back leads are unequal in length.

3. A coupler device as in claim 1 in which said left and right front leads are unequal in length and said left and right back leads are unequal in length so that said front and back strips are, respectively, offset from the midpoints in the overall lengths of, respectively, said front conductor and said rear conductor.

4. A coupler device as in claim 3 in which said front and back conductors are substantially equal in overall length.

5. A coupler device as in claim 4 in which the configuration in the front-to-rear transverse direction of said front conductor and front ground plane regions on said front surface of said board is the same as the configuration in the rear-to-front transverse direction of said back conductor and back ground plane regions on said back surface of said board.

6. A coupler device as in claim 1 in which said leads have, in their full lengths, greater and lesser extents adjacent to, respectively, said ports and said junctions at opposite ends of said leads, and in which said lead-bordering gaps to either side of each lead have widths over said greater extents of said leads which are enough greater than said board thickness to provide for transmission of microwaves along said greater extents of said leads primarily by a microstrip waveguide coupling over such greater extents of said leads with ground plane regions on the opposite side of said board from said leads.

7. A coupler device as in claim 6, in which said lead-bordering gaps have widths, over said greater extents of said leads, at least about twice as great as said board thickness, and in which said transmission of microwaves is substantially entirely by said microstrip wave guide coupling.

8. A coupler device as in claim 7 in which, at said junctions of each of said leads with their corresponding strips, at least one of said lead-bordering gaps to either side of each of said leads overlaps through said board with another of said leads and, moreover, narrows down to a width less than said board thickness, said narrowed gaps being productive of effective coplanar waveguide couplings of said leads with ones of said ground plane regions in the same plane as said leads at portions of such regions spaced from said leads by said narrowed gaps, and in which microwave transmission over the lengths of said leads undergoes transition from being substantially entirely by said microstrip waveguide coupling over said greater extents of said leads to being at least partly by such coplanar waveguide coupling over said lesser extents of said leads.

9. A coupler device as in claim 8 in which, to aid said transition, said device further comprises a plurality of plated through-holes disposed alongside of and adjacent to said narrowed gaps and extending through said board to electrically couple together ground plane regions, on respectively, the front surface and back surface of said board.

10. A coupler device as in claim 1 in which said front and back central strips form, with said front and back ground plane regions spaced from said strips by said strip-bordering gaps so as to be below said strips, a plurality of waveguide couplings for transmitting microwaves along said strips, and in which said central strips have no significant waveguide couplings with ground plane regions above said strips.

11. A coupler device as in claim 10 in which said device further comprises a plurality of plated through-holes disposed alongside and adjacent to said strip-bordering gaps and extending through said board from one to the other of such ground plane regions below said strips to increase the effectiveness of transmission of microwaves along said strips by such waveguide couplings.

12. A coupler device as in claim 1 in which said pluralities of front and back ground plane regions, on respectively, said front surface and back surface of said board are pluralities which respectively comprise a central region below said strips and rightward and leftward of, respectively the left and right leads on that surface, and left and right regions which are, respectively, leftward and rightward of the left and right leads on such surface, and in which said central and left and right regions in each such plurality all have respective terminations on that surface at said bottom margin of said board.

13. A coupler device as in claim 12 in which said device further comprises a longitudinally and transversely extending dielectric support board disposed below and abutting said bottom margin of said coupler board to mount said coupler board so that it stands up from said support board, said support board has, on its bottom surface, a main ground plane region, and on its top surface (a) a plurality of connector strips respective to, and electromechanically connected at said bottom margin to, said leads on said coupler board, and (b) plurality of supplemental ground plane regions, electromechanically connected to, respectively, said central regions, left regions and right regions on said coupler board and, in which said device further comprises a plurality of metallic plated through-holes extending vertically through said support board and electrically coupling said supplemental ground plane regions on said top surface of said support board to said main ground plane region on the bottom surface thereof.

14. A coupler device as in claim 13 in which ones of said center and left and right ground plane regions on at least one of said surfaces of said coupler board have formed in their terminations at such board's bottom margin a plurality of voids respective to such terminations and extending up from said support board and overlapping through said coupler board with leads on the opposite side of such board, and in which ones of said connector strips on said support board extend on such support board towards such one surface on said coupler board and then pass, under said coupler board, beneath and then beyond said voids to make respective electromechanical connections on such opposite side with such leads without electrically contacting any ground plane regions on said coupler board in the course of passing thereunder.

15. A microwave coupler device comprising, a horizontally and vertically extending dielectric coupler board having a longitudinally extending horizontal bottom margin, thickness in the transverse horizontal dimension, and front and back surfaces separated by said thickness, front metallic ground plane regions and back metallic ground plane regions disposed on, respectively, said front surface and said back surface to be in spaced relation from each other on the corresponding surface, such ground plane regions on each of said surfaces having respective terminations disposed on the corresponding surface at said bottom margin in longitudinally spaced relation from each other, front and back elongated metallic conductors extending on, respectively, said front surface and back surface between two terminations of each such conductor at opposite ends thereof and constituting two ports, said front and back conductors being spaced by gaps on said front surface and back surface from, respectively, said front ground plane regions and back ground plane regions, said ports of said front conductor and of said back conductor being disposed on the corresponding surface at said bottom margin so as to each be spaced in the longitudinal dimension from all the other ports on said board and from each of said ground plane region terminations on that surface at said bottom margin, said front and back conductors respectively comprising front and back central strips centrally located on said board and registering with each other through said board to be broadside coupled with each other, and said front and back conductors further comprising, respectively, left and right front leads and left and right back leads having respective junctions with left and right ends of, respectively, said front strip and said back strip, and extending on, respectively, said front surface and said back surface to respective of the two ports of said front conductor and back conductor, said leads and strip ends being left and right in the front-to-back transverse direction, and each of said leads over at least most of their extents being non-overlapping through said board with any other lead while being overlapping through said board with portions of ground plane regions on the opposite surface of said board.

16. A device as in claim 15 in which said front and back regions on said front and back surfaces comprise on each surface a central region below the central strip on that surface and rightward and leftward of, respectively, the left and right leads on that surface and left and right regions which are leftward and rightward of, respectively, the left and right leads on that surface, and in which each of said central and left and right regions on, respectively, said front surface and said back surface has a respective termination disposed at the bottom of said board and spaced in the longitudinal dimension from each of the two other ground plane region terminations on that surface at the bottom of said board.

17. A device as in claim 15 in which the configuration in the front-to-rear transverse direction of said front conductor and front ground plane regions on said front surface of said board is substantially the same as the configuration in the rear-to-front transverse direction of said back conductor and back ground plane regions on said back surface of said board.

18. A device as in claim 15 in which each of said two front leads and two back leads has, outwards of its junction with the corresponding strip, at least one slanting section and, beyond that slanting section, a vertical section forming with said slanting section a dogleg lower portion for that lead, such vertical sections of said two front leads and two back leads extending down to respective terminations of such sections constituting the four ports on said board.

19. A microwave coupler device comprising, a horizontally and vertically extending dielectric coupler board having a periphery, thickness in the horizontal transverse dimension and front and back surfaces separated by said thickness, front and back elongated metallic conductors extending on, respectively, said front surface and said back surface between opposite terminations of each conductor which are at the periphery of the corresponding surface, and which constitute ports, said front and back conductors respectively comprising front and back central strips centrally located on said board and broadside coupled with each other through said board, and said front and back conductors also respectively comprising two front leads and two back leads having junctions with opposite ends of, respectively, said front strip and said back strip and extending from such junctions to the ports on the corresponding surface of, respectively, said front conductor and back conductor, front metallic ground plane regions and back metallic ground plane regions disposed on, respectively, said front surface and back surface to be spaced from the conductor on that surface by gaps including lead-bordering gaps to either side of each lead on that surface, said leads over greater extents, adjacent to said ports, of their full lengths being overlapping through the board with portions of ground plane regions on the opposite surface of the board, and the lead bordering gaps to either side of said leads having widths over such extents which are enough greater than said board thickness to provide for transmission of microwaves over said greater extents of said leads at least primarily by a microstrip wave guide coupling of said leads with said ground plane regions with which said leads overlap through said board.

20. A coupler device as in claim 19 in which, over said greater extent of said leads, said lead bordering gaps have widths at least about twice as great as said board thickness, and in which said transmission of microwaves over said greater extents of said leads is substantially entirely by said microstrip wave guide coupling.

21. A microwave coupler device comprising a horizontally and vertically extending dielectric coupler board having a periphery, thickness in the horizontal transverse dimension and front and back surfaces separated by said thickness, front and back elongated metallic conductors extending on, respectively, said front surface and said back surface between opposite terminations of each conductor at the periphery of the corresponding surface and constituting ports, said front and back conductors respectively comprising front and back central strips centrally located on said board and broadside coupled with each other through said board, and said front and back conductors also respectively comprising two front leads and two back leads having junctions with opposite ends of, respectively, said front strip and said back strip and extending from such junctions to the two ports on the corresponding surface of, respectively, said front conductor and back conductor, front metallic ground plane regions and back metallic ground plane regions disposed on, respectively, said front surface and back surface to be each spaced from the conductor on that surface by gaps, and a plurality of plated through-holes disposed alongside of and adjacent to ones of said gaps and extending through said board to electrically couple together ground plane regions on, respectively, said front surface and back surface of said board.

22. A microwave coupler device comprising, a horizontally and vertically extending dielectric coupler board having thickness in the horizontal transverse dimension and front and back surfaces separated by said thickness, and also having respective peripheries including respective longitudinally extending bottom margins, front and back elongated metallic conductors extending on, respectively, said front surface and said back surface between opposite terminations of each conductor which are at the periphery of the corresponding surface, said front and back conductors respectively comprising front and back central strips centrally located on said board and broadside coupled with each other through said board, said front and back conductors also respectively comprising two front leads having junctions and two back leads with opposite ends of, respectively, said front strip and said back strip and extending from such junctions to corresponding ones of said terminations on the surfaces bearing, respectively, said front conductor and back conductor, front metallic ground plane regions and back metallic ground plane regions disposed on, respectively, said front surface and back surface to be spaced from the conductor on each such surface by lead-bordering gaps beside the leads on that surface, and by strip bordering gaps below said strips, said leads overlapping over at least most of their full lengths with portions of ground plane regions on the opposite surface of said board, and said device being characterized by the features that the terminations of, respectively, said front leads and back leads are all at the bottom margins of such surfaces and are each longitudinally spaced from the others in the length of said board.

* * * * *